US008794442B2

(12) United States Patent
Nicoletti

(10) Patent No.: US 8,794,442 B2
(45) Date of Patent: Aug. 5, 2014

(54) PACKAGE STRUCTURE FOR GLASS CONTAINERS FOR PHARMACEUTICAL USE

(75) Inventor: Fabiano Nicoletti, Mira (IT)

(73) Assignee: Stevanato Group International A.S., Bratislava (SK)

( * ) Notice: Subject to any disclaimer, the term of this patent is extended or adjusted under 35 U.S.C. 154(b) by 0 days.

(21) Appl. No.: 13/351,959

(22) Filed: Jan. 17, 2012

(65) Prior Publication Data

US 2012/0114457 A1 May 10, 2012

Related U.S. Application Data

(62) Division of application No. 12/671,671, filed as application No. PCT/EP2008/006232 on Jul. 29, 2008, now Pat. No. 8,360,238.

(30) Foreign Application Priority Data

Aug. 2, 2007 (CH) ..... 1232/07

(51) Int. Cl.
*B65D 1/34* (2006.01)

(52) U.S. Cl.
USPC ..... 206/560; 206/486; 206/562

(58) Field of Classification Search
USPC ..... 206/443, 480, 486, 488, 490, 499, 557, 206/560, 562, 563, 565; 211/74, 85.18, 211/85.29; 248/309.1, 311.2, 311.3, 314
See application file for complete search history.

(56) References Cited

U.S. PATENT DOCUMENTS

| | | | | |
|---|---|---|---|---|
| 1,957,263 | A * | 5/1934 | Gray | 211/74 |
| 3,643,812 | A | 2/1972 | Mander et al. | |
| 4,124,122 | A * | 11/1978 | Emmitt | 211/74 |
| 4,585,119 | A * | 4/1986 | Boyington | 211/74 |
| 5,047,019 | A * | 9/1991 | Sincock | 206/486 |
| 5,579,929 | A * | 12/1996 | Schwartz | 211/74 |
| 5,651,941 | A * | 7/1997 | Stark et al. | 422/562 |
| 5,779,984 | A | 7/1998 | Kelly et al. | |
| 6,123,205 | A * | 9/2000 | Dumitrescu et al. | 206/443 |
| 2005/0133512 | A1 | 6/2005 | Prokopp | |

FOREIGN PATENT DOCUMENTS

| | | |
|---|---|---|
| BE | 569 572 | 8/1958 |
| DE | 73 07 208 | 5/1973 |
| DE | 203 19 100 | 3/2004 |
| EP | 0 270 326 | 6/1988 |
| FR | 1 552 324 | 1/1969 |
| WO | 2007/143671 | 12/2007 |

OTHER PUBLICATIONS

International Search Report dated Nov. 27, 2008 in International Application No. PCT/EP2008/006232.
International Preliminary Report on Patentability including the Written Opinion of the International Searching Authority dated Feb. 2, 2010 in International Application No. PCT/EP2008/006232.

* cited by examiner

*Primary Examiner* — Luan K Bui
(74) *Attorney, Agent, or Firm* — Ohlandt, Greeley, Ruggiero & Perle, L.L.P.

(57) ABSTRACT

The package structure for glass containers for pharmaceutical use (e.g.: bottles, carpules and phials . . . ), comprises a tray (2) accommodating, at a raised position with respect to its bottom, a support plane (4) having a plurality of holes (12) for introducing containers spaced with a preset spatial order, the support plane comprising, at each introduction hole, elastically yielding means (13) for holding the container by means of a radial holding force, the holding means extending inside the volume enclosed by the projection of the perimeter of the hole in a manner parallel to the central symmetry axis (S) of the latter.

4 Claims, 7 Drawing Sheets

1
10
4
11
8
2
9

10
4
13
6
2
30
7
8

13
12
S
5

10
8
7
2
4
9

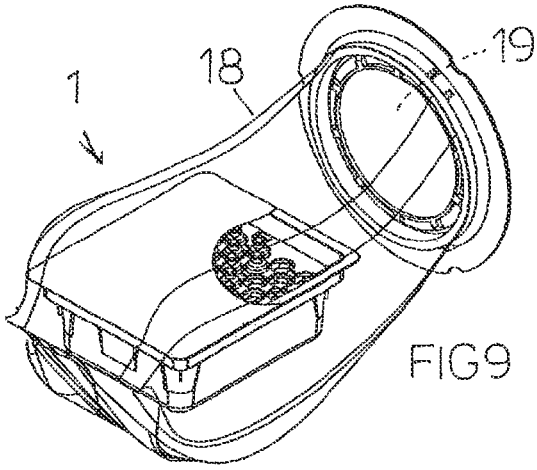
FIG9
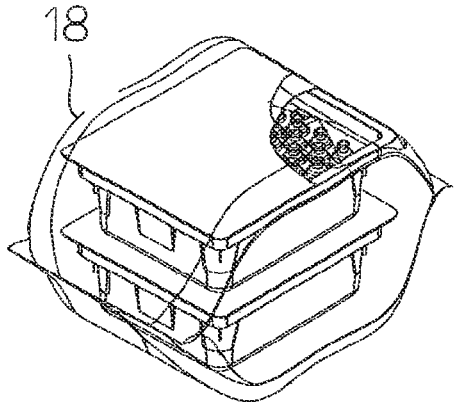
FIG10
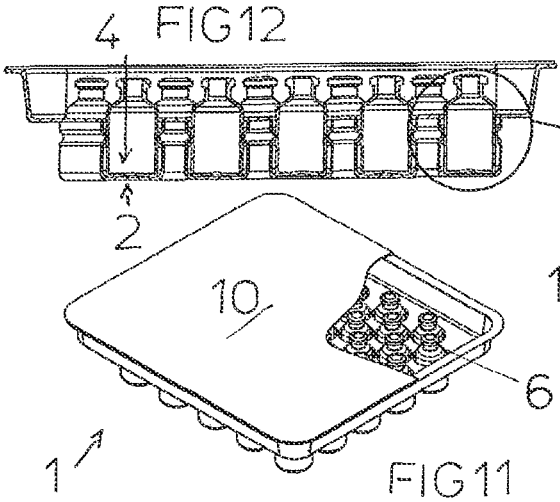
FIG12
FIG11
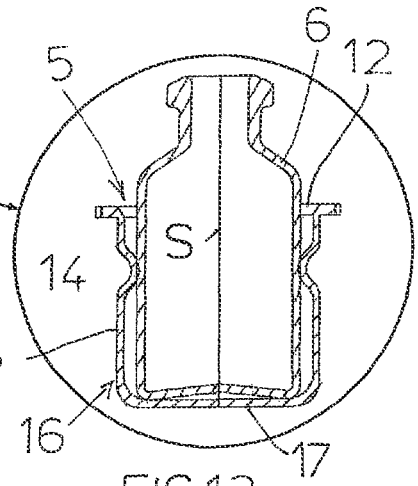
FIG13

PACKAGE STRUCTURE FOR GLASS CONTAINERS FOR PHARMACEUTICAL USE

CROSS REFERENCE TO RELATED APPLICATIONS

This application is a divisional of application Ser. No. 12/671,671, filed Feb. 1, 2010, U.S. Pat. No. 8,360,238, which is a U.S. national phase application of International Application No. PCT/EP2008/006232, filed Jul. 29, 2008, which claims benefit from Swiss Application No. 1232/07, filed Aug. 2, 2007, all of which are hereby incorporated herein by reference in their entirety.

FIELD

The present invention refers to a package structure for glass containers for pharmaceutical use.

BACKGROUND

Known is a package structure for sterilised syringes comprising a container with closed bottom holding therein a grid having a plurality of accommodation holes wherein arranged with a vertical orientation are the syringes held into position by simply placing their flange at the perimeter edge of the accommodation holes.

The system for holding a package structure for sterilised syringes is ineffective and unsuitable for holding functioning with bottles or similar containers not provided with projecting parts.

Such packaging structure for syringes has a limited flexibility in use in that it is not suitable to be used effectively both for containers different from syringes available in the market and machinery for filling containers different from syringes available in the market, for example glass bottles, carpules and phials for pharmaceutical use.

In particular, it is not possible to insert glass containers for pharmaceutical use into such structure for delivery to the pharmaceutical companies, ready to be filled.

Therefore, the technical task proposed by the present invention is that providing a package structure for glass containers for pharmaceutical use capable of eliminating the technical drawbacks observed in the prior art.

SUMMARY

Within the scope of this technical task an object of the invention is that of providing a package structure for glass containers for pharmaceutical use capable of allowing to hold the containers into a preset position in a stable manner also in order to protect them against accidental breakages and in order to be able to deliver them to the pharmaceutical companies ready for filling.

Another object of the invention is that of providing a package structure for glass containers for pharmaceutical use capable of guaranteeing the sterilisation of the product, maintaining the sterility of the product, maintaining the quality characteristics of the product, proving the integrity of the product, identification and traceability of the product, transfer of the product without jeopardising the aforelisted properties.

Last but not least, an object of the invention is that of providing a package structure for glass containers for pharmaceutical use capable of allowing an easy and quick step for loading glass containers into a process machine for handling thereof, in particular for filling, closure, packaging, etc thereof.

The technical task, as well as these and other objects, according to the present invention are attained by providing a package structure for glass containers for pharmaceutical use according to claim 1.

Furthermore, other characteristics of the present invention are defined in the subsequent claims.

BRIEF DESCRIPTION OF THE DRAWINGS

Further characteristics and advantages of the invention shall be clearer from the description of a preferred but not exclusive embodiment of the package structure for glass containers for pharmaceutical use according to the finding, illustrated for indicative and non-limiting purposes in the attached drawings, wherein:

FIGS. 9 and 10 illustrate possible variants for the external protection casing of one or more trays of a package structure for glass containers for pharmaceutical use according to any one of the embodiments illustrated in the preceding figures;

FIG. 11 shows a perspective view of a package structure for glass containers for pharmaceutical use according to a third preferred embodiment of the invention;

FIG. 12 shows a cross-sectional view according to a vertical plane of the package structure of FIG. 11;

FIG. 13 shows an enlargement of a detail circled in FIG. 12;

DETAILED DESCRIPTION OF THE DRAWINGS

Figures 1, 2, 3, 4:
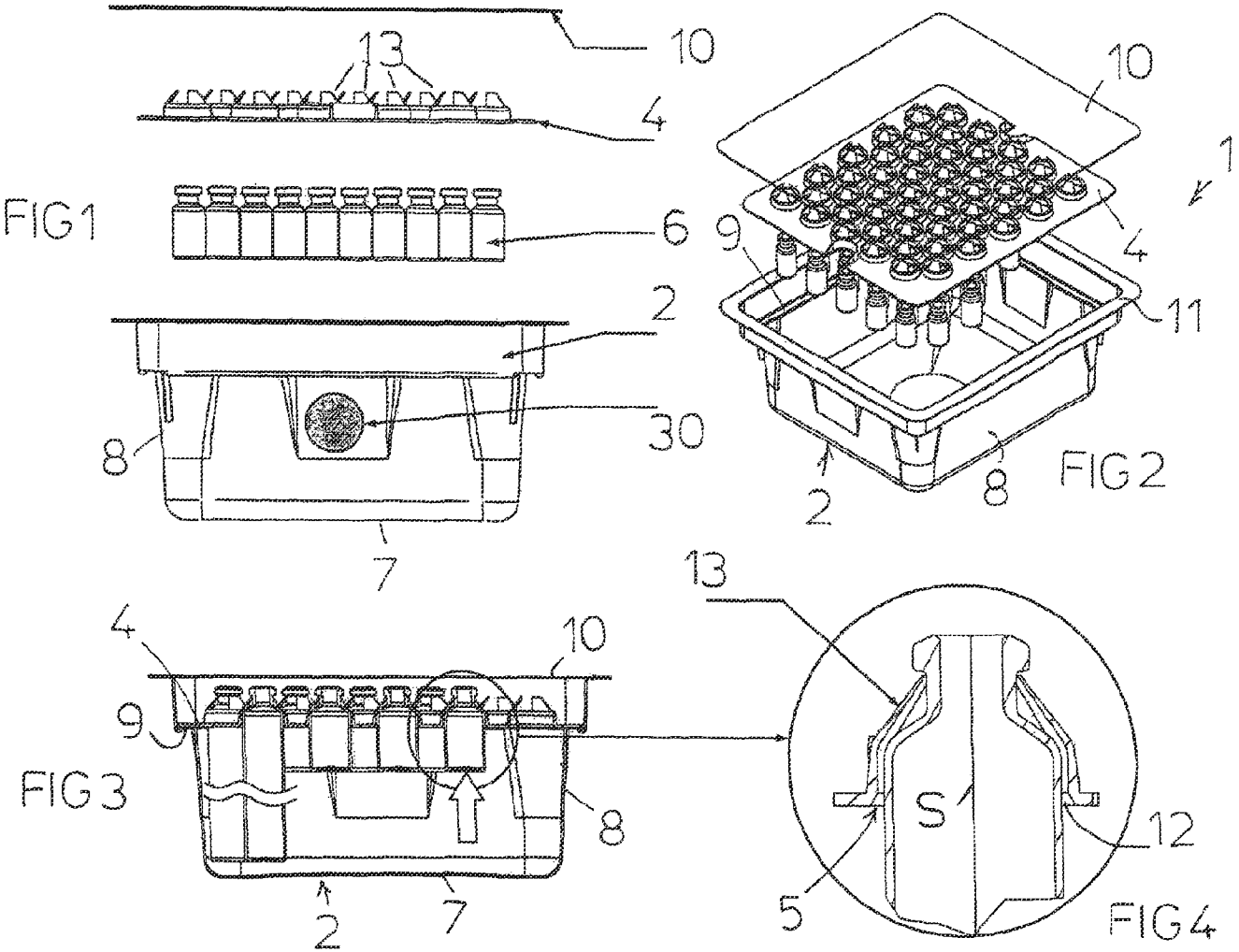
FIG. 1 shows a side elevated exploded view of a package structure for glass containers for pharmaceutical use according to a first preferred embodiment of the invention.
FIG. 2 shows a perspective exploded view of the package structure of FIG. 1.
FIG. 3 shows a cross-sectional view according to a vertical plane of the package structure of FIG. 1.
FIG. 4 shows an enlargement of a detail circled in FIG. 3.
Figures 5, 6, 7, 8:
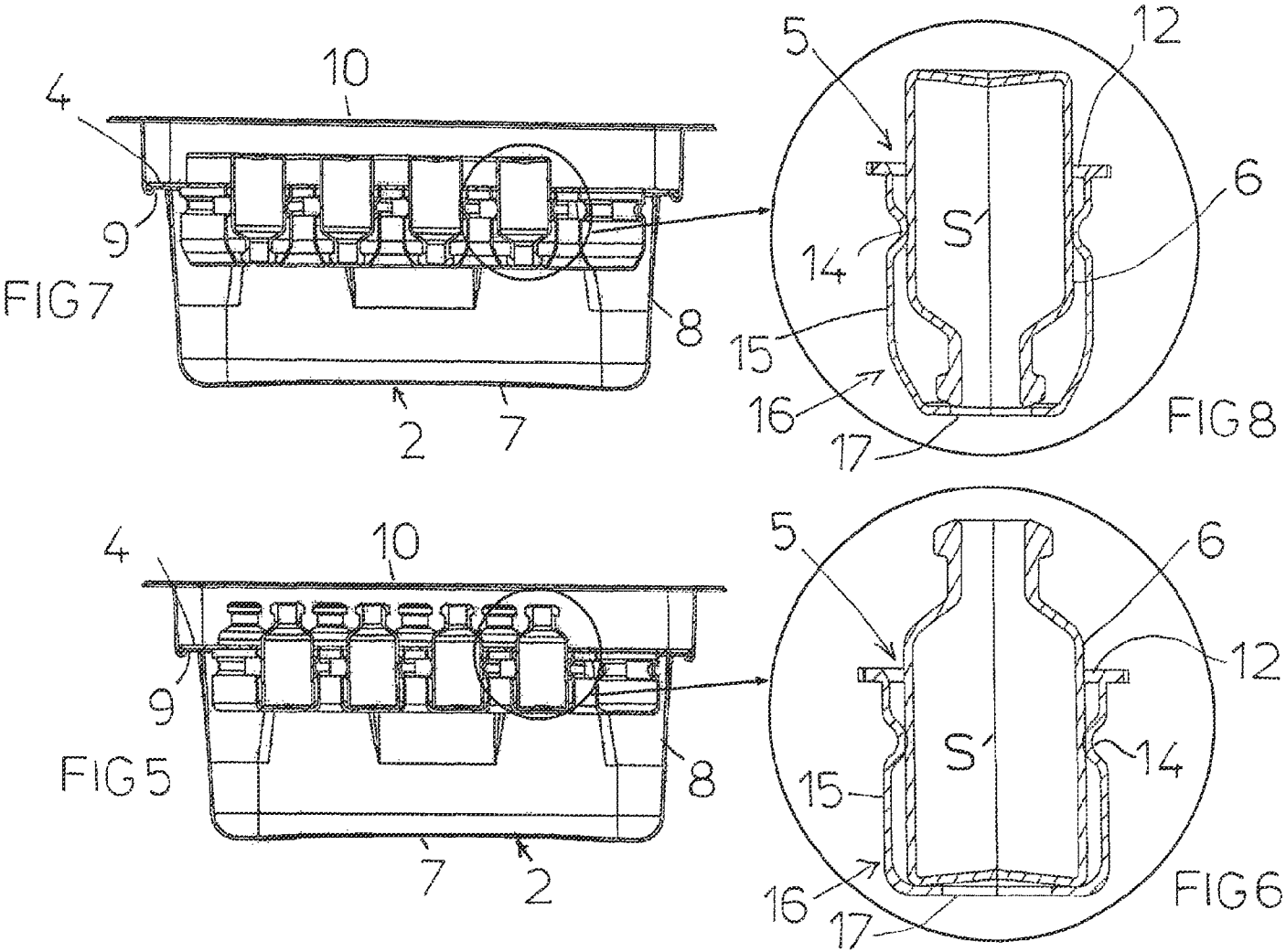
FIG. 5 shows a cross-sectional view according to a vertical plane a package structure for glass containers for pharmaceutical use according to a second preferred embodiment of the invention.
FIG. 6 shows an enlargement of a detail circled in FIG. 5.
FIGS. 7 and 8 correspond to the embodiment of FIGS. 5 and 6 but with the containers held overturned at a position of 180.degree.

Identical parts in the various embodiments shall be indicated with the same reference number.

Referring to the abovementioned figures, a package structure for glass containers for pharmaceutical use is shown indicated in its entirety with reference number 1.

The package structure 1 comprises a tray 2 accommodating—at an elevated position with respect to its bottom—a support plane 4 having a plurality of holes 12, spaced with a preset spatial order, for introducing the containers 6.

The holes 12 have a central symmetry axis S orthogonal with respect to the support plane 4.

The support plane 4 has—at each hole 12—special elastically yielding means for holding a container 6 through a holding force radial with respect to the central symmetry axis S.

The holding means extend into the volume enclosed by the projection of the perimeter of the introduction hole 12 in a manner parallel with respect to the central symmetry axis S.

As clear from the description and illustration of the various preferred embodiments of the invention, the holding means can be arranged beneath the support plane 4, above the support plane 4, or inside the introduction hole 12 and thus in a manner coplanar with the support plane 4.

Optionally, as clear from the description and illustration of some preferred embodiments of the invention, the support plane 4 has—at each introduction hole 12—special support means 5 for nearing the weight of the container 6 also through a support force parallel with respect to the central symmetry axis S.

The introduction holes 12, which preferably—as shown—are circular-shaped, advantageously have a matrix order arranged in series of rows and columns which facilitates a possible automated movement and handling of the containers 6.

The tray 2 has a quadrangular bottom 7 raising from which are side walls 8.

The support plane 4 is supported perimetrally by a support shoulder 9 which develops along the internal surface of the side walls 8 of the tray 2.

The distance of the support plane 4 from the bottom 7 of the tray 2 must be such to allow accommodating the containers 6 in the holes 12 in such a manner that they are held for their entire length of the space enclosed between the tray 2 and one of its closure covers 10.

The closure cover 10 is preferably a flexible flat sheet which can be applied for example through ultrasonic fastening against the flattened upper edge 11 of the side walls 8 of the tray 2 in a way to be removed therefrom through simple exfoliation, that is by pulling a special strip of the sheet.

In the preferred embodiment illustrated in FIGS. 1-4 the means for holding the container 6 comprise, for each hole 12, flaps 13 adapted to elastically fit against the lower diameter of the neck of the container 6.

In particular, the flaps 13 develop entirely around the introduction hole 12 and above it with a longitudinal development axis having a first axial component radially directed towards the central symmetry axis S and a second axial component directed in a manner parallel with respect to the central symmetry axis S.

In this case, both the centred holding of the container 6 and the support of its weight are ensured only by the elastic flaps 13.

As a matter of fact, their first axial component generates a force ensuring the centred holding of the container 6 in the introduction hole 12 while their second axial component generates a force operating for supporting the weight of the container 6.

On the other hand, in the preferred embodiment illustrated in FIGS. 5-8 the means for holding the container 6 comprise, for each hole 12, at least one rib 14 which develops along a centred circumference on the central symmetry axis S and adapted to elastically fit against the external parameter of the side wall of the container 6.

In this case, the support means 5 for bearing the container 6 comprise a basket 16 projecting from the support plane 4 beneath the hole 12, and the rib 14 is provided right along the side surface of the basket 16.

Thus, the container 6 is arranged in the basket 16 whose base 17 serves as a support for the base (FIGS. 7 and 8) or for the head (FIGS. 5 and 6) of the container 6.

Contrary to the preferred embodiment illustrated in FIGS. 5-8 wherein the support plane 4 is borne in the tray 2, in the preferred embodiment illustrated in FIGS. 11-13 the tray 2 and the support plane 4 are integrated into a single piece. Alongside implying a more limited number of parts, the latter solution can have a small overall dimension in terms of height and it is suitable especially for use in short containers. Given that the containers 6 are placed at the bottom of the tray 2 the height of the tray 2 must be only slightly greater than the height of the containers 6 in such a manner to be able to hold them entirely therein.

On the other hand, referring to embodiments illustrated in FIGS. 15-18, the flaps 13 develop inside the introduction hole 12 with a longitudinal development axis radially directed towards the central symmetry axis S.

In this case, the support plane 4 has two flat parts 4*a* and 4*b* formed in a mirror-like manner and mutually fastenable in an overlapped position by means of a bayonet fastening system which develops perimetrally on the support plane 4 and provides for mutual engagement members 42 and 43 respectively, one of which is provided with a snap-tooth 40 couplable into a special snap-seat 41 of the other by means of relative translation sliding between the flat part 4*a* and the flat part 4*b* for example along a translation axis parallel to the greater axis of the support plane 4.

Preferably, also provided for is a system for locking the flat part 4*a* and the flat part 4*b* in the final configuration of complete overlapping.

The locking system, also provided for perimetrally on the support plane 4 and more precisely at the sides of the support plane 4 orthogonal to the axis of mutual translation between the flat parts 4*a* and 4*b*, comprise at least one hook 46 which can be snap-fitted into an engagement hole 47 preferably accessible only by means of a special tool for the subsequent disengagement of the hook 46.

The flaps 13 are at least two and they are provided for one on the flat part 4*a* and one on the flat part 4*b* in a manner such to be arranged diametrically in the introduction hole 12 for grasping on the diameter of the neck of the container 6 when the flat part 4*a* and the flat part 4*b* are entirely overlapped.

In this case, the introduction hole 12 has radial protrusions 44 adapted to increase the longitudinal development of the flaps 13 and reduce their portion for attaching against the support plane 4 to increase their elastic flexibility.

In this embodiment of the invention, the means 5 for supporting the container 6 comprise an internal flange 45 of the introduction hole 12 for supporting the base of the head of the container 6.

The flange 45 extends into the introduction hole 12 for a radial section smaller than the one with which the flaps 13 extend into the introduction hole so as not to interfere with the hole of the container 6.

The flange 45 is subdivided into at least two portions—one borne by the flat part 4*a* and the other by the flat part 4*b*—in such a manner to be aligned diametrically in the introduction hole 12 when the flat part 4*a* and the flat part 4*b* are entirely overlapped.

The implementation of the forces by the flaps 13 and the flange 45 at diametrically opposite ends of the container 6 allows providing a safe and stable holding in centered position of the container 6.

The tray 2 advantageously has means 30 for the identification and traceability of the product contained in the container 6, preferably an identification code of the RFID type.

The package structure 1 is completed by at least one external protection casing 18 which encloses a tray 2 therein, and allows its transfer to an area with a controlled environment (e.g.: an area where the glass containers are filled for pharmaceutical use).

The protection casing 18 can be closed (FIG. 10) or open and in particular provided with at least one opening 19 for quick transfer (FIG. 9).

Each protection casing 18 can contain one or more stacked trays 2.

The protection casing 18 is preferably made up of a bag or a plastic sheet.

Figure 14:
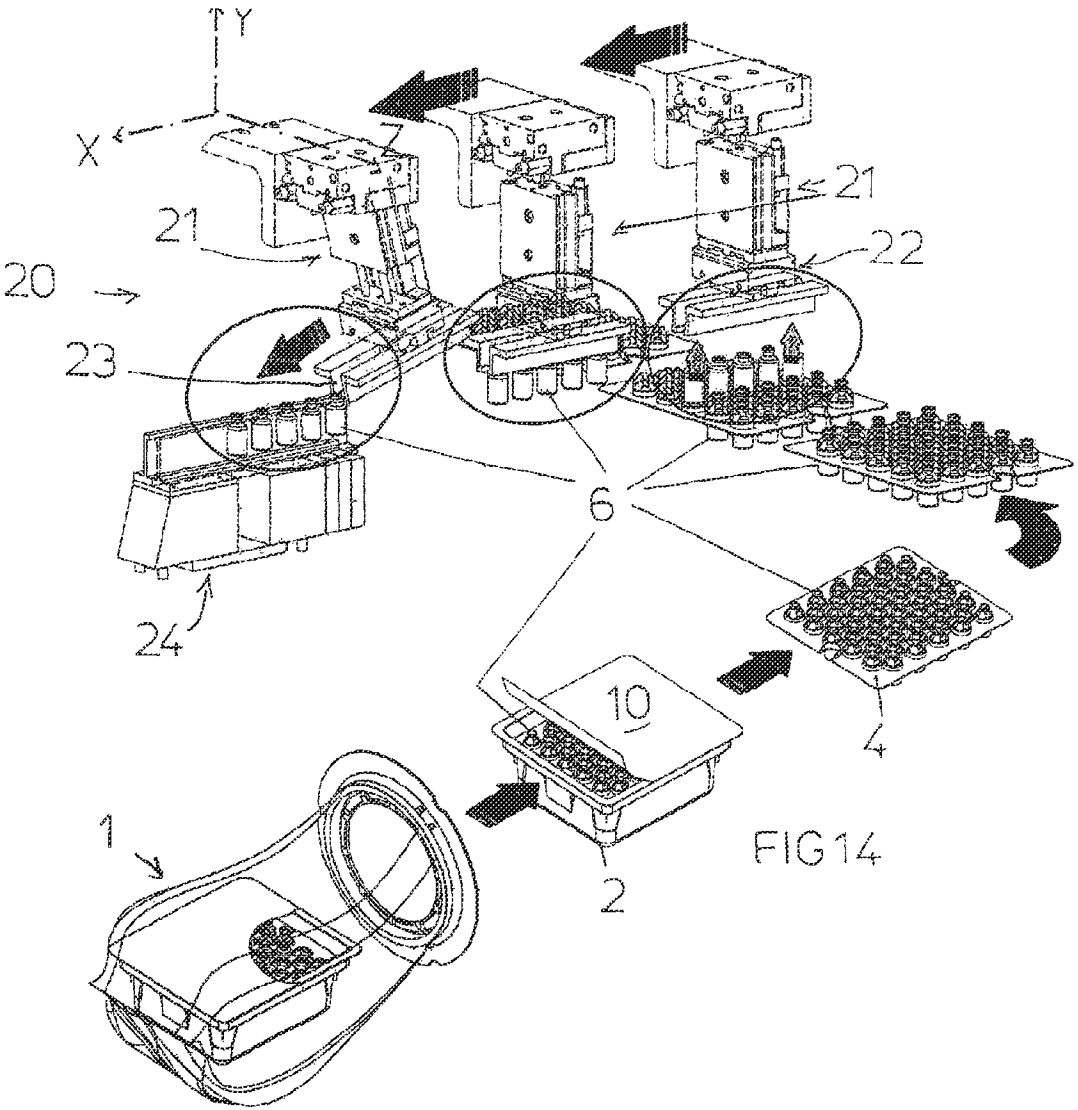
FIG. 14 shows the various sequential steps for the direct use of a package structure for glass containers for pharmaceutical use in a process machine.
Figure 15:
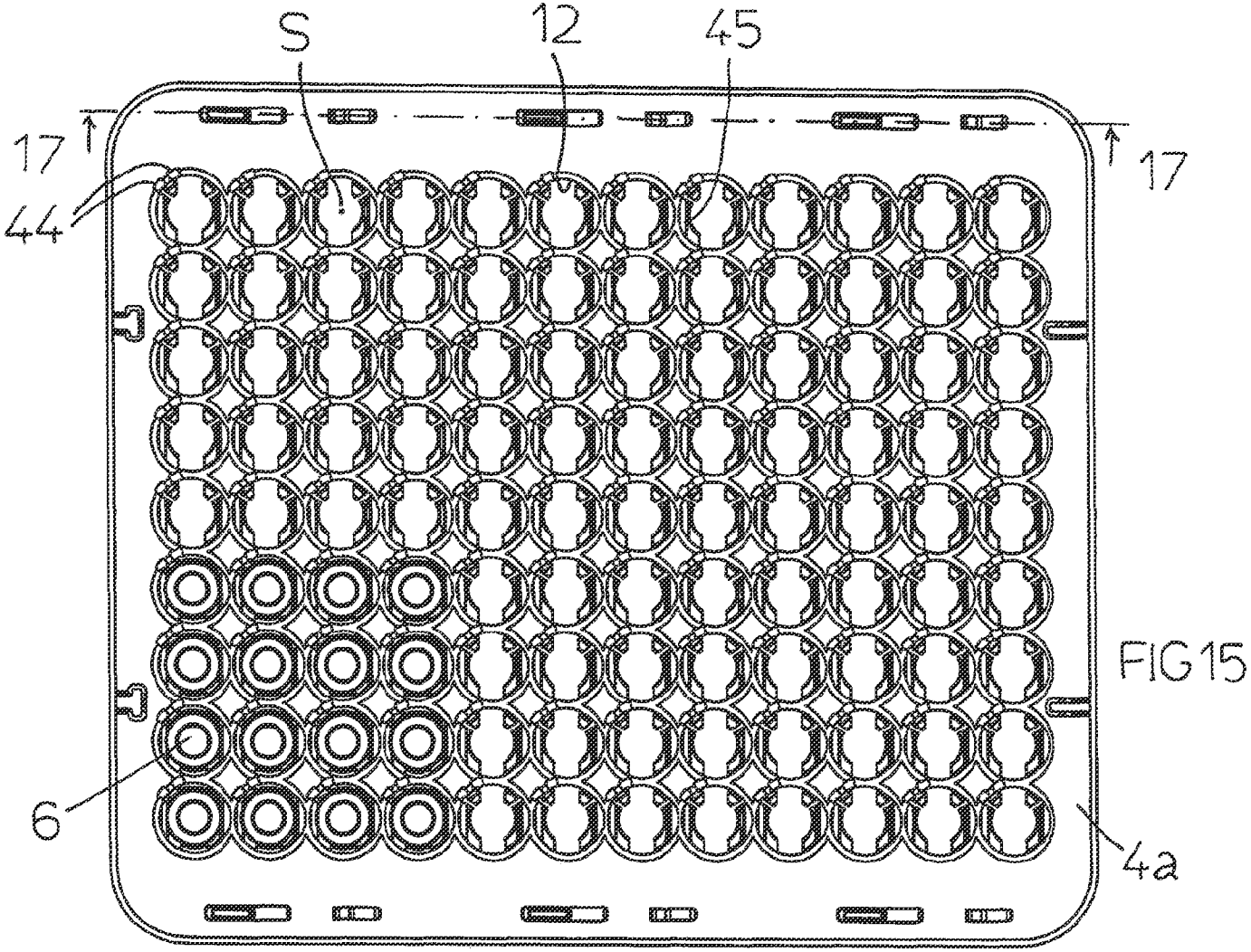
FIG. 15 shows a top plan view of a support plane according to a further preferred embodiment of the invention.
Figure 16:
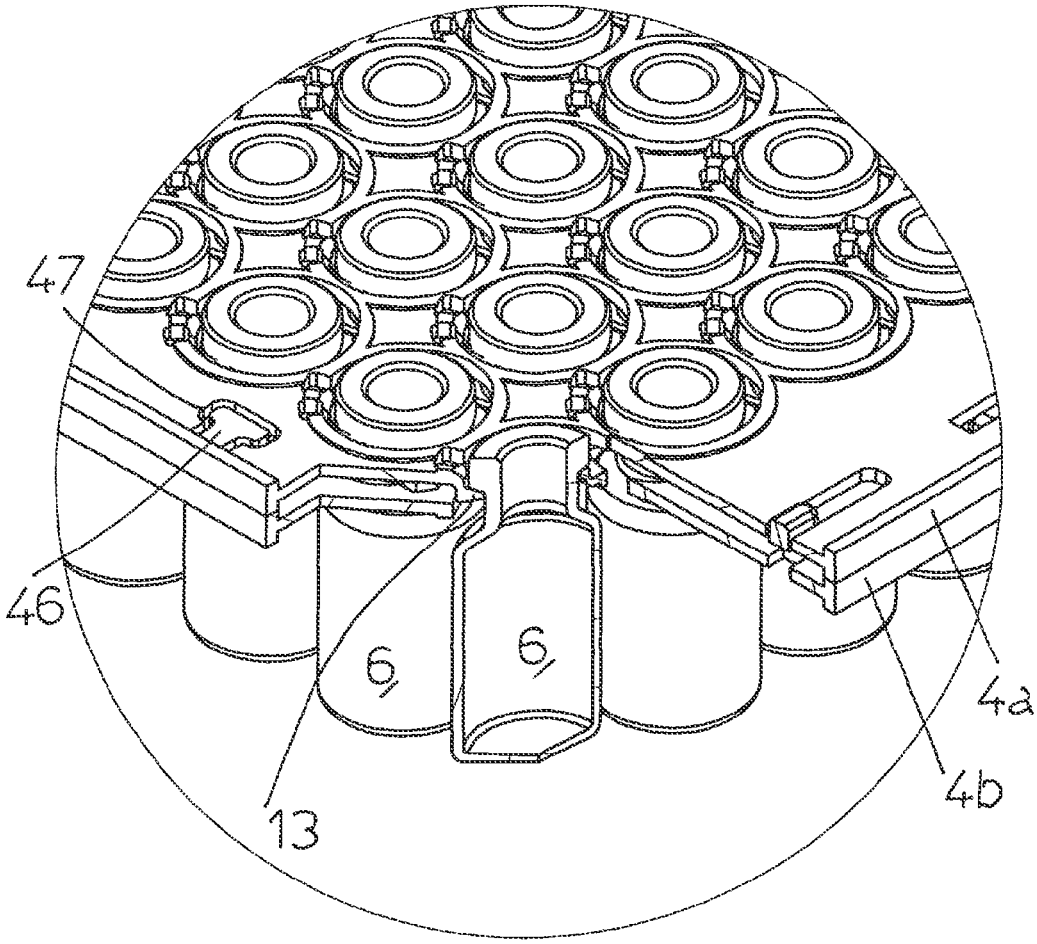
FIG. 16 shows a perspective view of an enlarged detail of the support plane of FIG. 15.
Figure 17:
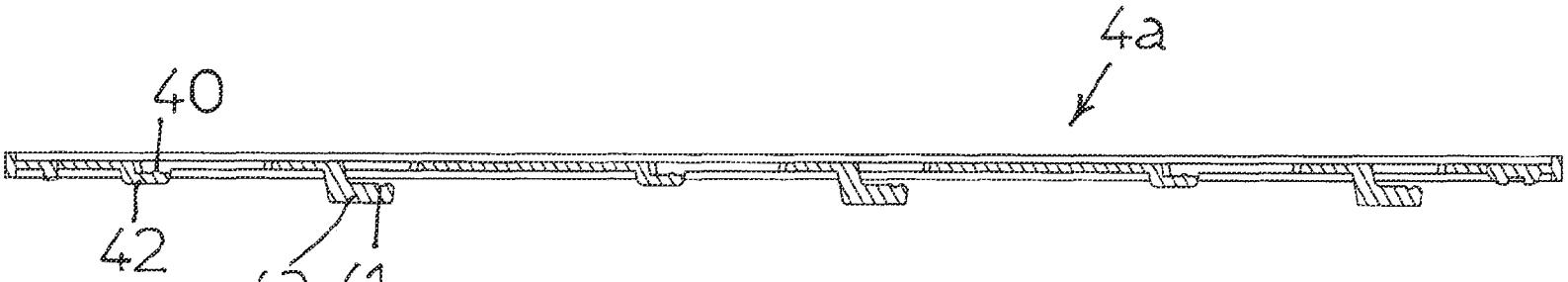
FIG. 17 shows a view of one of the two parts forming the support plane sectioned along line 17-17 of FIG. 15.
Figure 18:
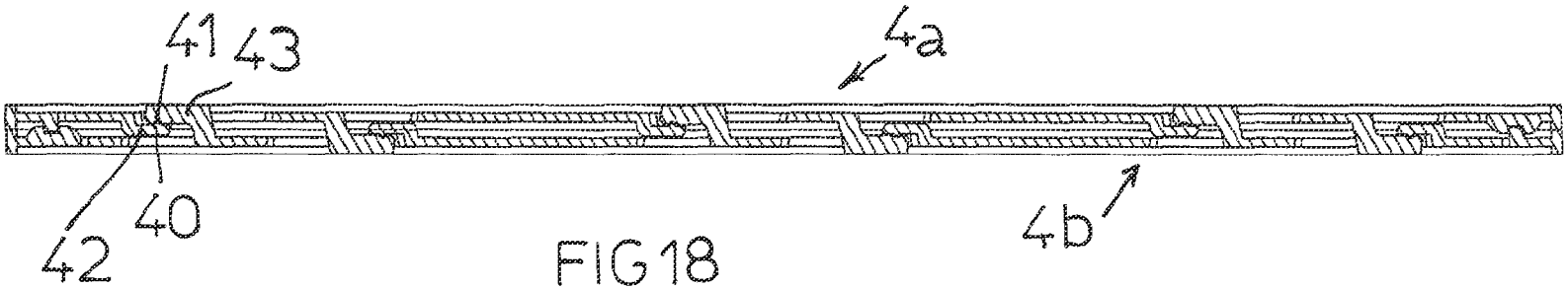
FIG. 18 shows a view of the two assembled parts forming the support plane sectioned along line 17-17 of FIG. 15.

Now, referring to FIG. 14 shown is the package structure 1 for directly delivering—in an automatic manner—the containers 6 with a spatially preset position to a process machine 20 for their handling thereof.

The process machine 20 comprises a robotised arm 21 provided with a head 22 for grasping the containers 6.

The robotised arm 21 has a horizontal translation axis X, a vertical translation axis Y and a rotation axis Z orthogonal to the translation axis X and Y.

The grasping head 22 has an open rectilinear groove 23 for grasping a row of containers 6.

After being extracted from the external casing 18 and being removed of the cover 10, the support plane 4 (or the tray 2 if integral with the support plane 4) is moved towards the grabbing position by the grabbing head 22 wherein the containers 6 are arranged in rows oriented in a manner parallel to the axis X.

In particular, the grabbing head 22 is initially external with respect to the support template 4 and has a groove 23 oriented in a manner parallel to the axis X.

The grabbing head 22 translates along axis X to insert the groove 23 into the neck of the row of containers 6 aligned with the groove 23 itself.

After having engaged the row of containers 6, the grabbing head 22 translates along axis Y to lift the row of containers 6 engaged detaching it from the support 4.

Subsequently, the grabbing head 22 translates along axis X to transport the engaged row of containers 6 towards a conveying station 24 at which the grabbing head 22 rotates around axis Z to slide the engaged row of containers 6 towards it.

The package structure for glass containers for pharmaceutical use thus conceived is susceptible to various modifications and variants, all falling within the scope of the invention concept; furthermore, all the details can be replaced by technically equivalent elements.

In practice, all the materials used, alongside the dimensions, may vary depending on the requirements and the state of art.

The invention claimed is:

1. Package structure for glass containers for pharmaceutical use, comprising a tray accommodating at a raised position with respect to its bottom a support plane having, for the introduction of said containers, a plurality of holes spaced from each other with a preset spatial order and having a central symmetry axis orthogonal to said support plane, said support plane further holding, at each of said holes, elastically yielding means for holding a container by means of a holding force radial with respect to said central symmetry axis, said holding means extending into the volume enclosed by a projection of the perimeter of each of said holes in a direction parallel to said central symmetry axis, wherein said holding means are arranged beneath said support plane, wherein said holding means comprise at least one rib which develops along a circumference centered on said central symmetry axis and is adapted to elastically fit against equally distributed areas around a circumference of, or the entire circumference of, an external perimeter of a side wall of a container received within said hole, wherein each of said holes has an associated basket projecting from the support plane and beneath said holes and said at least one rib is formed in the basket, and wherein the basket has an internal side surface in which the rib is formed and a base which serves as support for a base or head of a container received in the basket, wherein the at least one rib extends along a circumferential line of the internal side surface of the basket, wherein an external side of the basket opposite the internal side surface in which the rib is formed is concave, the basket being configured to retain the container such that at least a portion of the container is supported on the base of the basket and at least a portion of the container projects above the support plane, wherein the support plane is supported perimetrally by a support shoulder which extends along the internal surface of all the side walls of the tray, the shoulder being located closer to the top than to the bottom of the tray and separates a lower portion of the tray from a perimetrally larger upper portion of the tray.

2. The package structure of claim 1, wherein the basket is configured to retain the container such that at least a portion of the head of the container is supported on the base of the basket and at least a portion of the base of the container projects above the support plane.

3. The package structure of claim 1, wherein the basket permits removal of the container when the container is retained in the basket and engaged by the at least one rib.

4. The package structure of claim 1, further comprising a cover for sealing the tray.

* * * * *